US005115771A

United States Patent [19]

Ozawa

[11] Patent Number: 5,115,771

[45] Date of Patent: May 26, 1992

[54] METHOD OF COOLING CYLINDER LINERS IN AN ENGINE

[75] Inventor: Godo Ozawa, Oyama, Japan

[73] Assignee: Kabushiki Kaisha Komatsu Seisakusho, Japan

[21] Appl. No.: 684,954

[22] PCT Filed: Aug. 30, 1989

[86] PCT No.: PCT/JP89/00886

§ 371 Date: Apr. 29, 1991

§ 102(e) Date: Apr. 29, 1991

[87] PCT Pub. No.: WO91/03632

PCT Pub. Date: Mar. 21, 1991

[51] Int. Cl.[5] ..... F02F 1/10

[52] U.S. Cl. ..... 123/41.72; 123/193.2

[58] Field of Search ..... 123/41.72, 41.74, 193 C

[56] References Cited

U.S. PATENT DOCUMENTS

| | | | |
|---|---|---|---|
| 1,904,070 | 4/1933 | Morgan | 123/41.72 |
| 3,315,652 | 4/1967 | Ries et al. | 123/41.31 |
| 3,389,693 | 6/1968 | Herschmann | 123/41.84 |
| 3,853,099 | 12/1974 | Feather et al. | 123/41.82 |
| 4,284,037 | 8/1981 | Kasting et al. | 123/41.72 |
| 4,305,348 | 12/1981 | Martin | 123/41.72 |
| 4,385,595 | 5/1983 | Shaw | 123/193 C |

FOREIGN PATENT DOCUMENTS

| | | | |
|---|---|---|---|
| 677634 | 6/1939 | Fed. Rep. of Germany | 123/41.74 |
| 52-84334 | 7/1977 | Japan . | |
| 58-106518 | 7/1983 | Japan . | |
| 63308226 | 6/1990 | Japan . | |
| 69838 | 6/1914 | Switzerland | 123/41.72 |

*Primary Examiner*—Noah P. Kamen

*Attorney, Agent, or Firm*—Welsh & Katz, Ltd.

[57] ABSTRACT

The present invention includes an apparatus for cooling a plurality of cylinder liners in an engine wherein a thermal insulating layer comprising an annular groove is formed in a region in the vicinity of the upper part of each cylinder liner in the cylinder block while surrounding the upper part of the cylinder liner in a slightly spaced relationship relative to the cylinder liner in order to positively elevate the temperature on the wall surface of the cylinder liner at the upper part of the same and moreover a water jacket is formed in the cylinder block so as to allow coolant to flow from the lower part toward the upper part of the cylinder liner, the sectional area of the water jacket being gradually reduced from the lower part toward the central part of the cylinder liner.

4 Claims, 6 Drawing Sheets

METHOD OF COOLING CYLINDER LINERS IN AN ENGINE

TECHNICAL FIELD

The present invention relates generally to a method of cooling a plurality of cylinder liners in an engine. More particularly, the present invention relates to a method of cooling a plurality of cylinder liners arranged in the cylinder block of a diesel engine.

BACKGROUND ART

In general, to cool a plurality of cylinder liners in a water-cooling type diesel engine, a water jacket is formed in the region in the vicinity of each cylinder liner in a cylinder block so as to allow a coolant to be pumped to the water jacket.

As the cylinder liners are conventionally cooled, distribution of the temperature on the wall surface of each cylinder liner generally varies as represented by a curve A in FIG. 2.

With respect to the configuration of a water jacket for a comparatively small-sized diesel engine having a piston displacement smaller than five liters, a sectional configuration of the water jacket is dimensioned to have a narrower width W approaching the upper part thereof, i.e., the cylinder head side, as shown in a sectional view in FIG. 5. It should be noted that formation of the sectional configuration of the water jacket having a narrower width W approaching the upper part thereof in the above-described manner has been hitherto disclosed in an Official Gazette of e.g., Japanese Laid-Open Utility Model No. 153843/1985.

To assure that an engine generates a sufficiently large output with a supercharged intake air with the aid of a supercharger or the like, a proposal has been already made such that each cylinder liner is molded of a ceramic material or the like material so as to thermally insulate the whole cylinder liner. With respect to the engine constructed in the above-described manner, the temperature on the wall surface of each cylinder liner is distributed as represented by curve B in FIG. 2. As in apparent from curve B, the wall temperature is elevated not only at the upper part of the cylinder liner but also in the region extending from the central part toward the lower part of the cylinder liner.

The relationship between the temperature on the wall surface of each cylinder liner and the quantity of consumption of a lubricant oil is generally represented by the graph in FIG. 4. It has been found that the quantity of consumption of the lubricant oil is increased in substantial proportion to elevation of the temperature on the wall surface of each cylinder. For this reason, with respect to the afore-mentioned engine adapted to generate a large output with a supercharged intake air with the aid of a supercharger or the like, when the whole cylinder liner is thermally insulated, there arises the problem that the quantity of consumption of a lubricant oil increases because of the elevated temperature of the whole cylinder liner.

In addition, since the intake air is increasingly heated and expanded as the temperature of the whole cylinder liner is elevated, there arises other problems: intake air charging efficiency is degraded, properties in respect of the color of exhaust gas and the quality of particulates are deteriorated; moreover, the quantity of nitrogen oxides ($NO_x$) increases due to elevation of the combustion temperature associated with elevation of the temperature on the wall surface of each cylinder liner at the end of a compression stroke.

On the other hand, as schematically illustrated in FIG. 6, a cooling system for a small-sized engine having a piston displacement smaller than five liters is constructed such that a coolant delivered from a water pump P is supplied to a water jacket c formed around a fore cylinder liner b, the coolant is then supplied to an intermediate cylinder liner b from the fore cylinder liner b and the coolant is finally supplied to a rear cylinder liner b from the intermediate cylinder liner b. It should be noted that among outlet ports on a cylinder block d which each communicate with a cylinder head (not shown) a rearmost outlet port e has a cross-sectional flow passage area twice that of other outlet ports e.

However, with respect to the cooling system shown in FIG. 6, since the fore cylinder liner b is sufficiently cooled by the coolant but the intermediate cylinder liner b and the rear cylinder liner b are insufficiently cooled by the warm coolant with an elevated temperature the temperature on the wall surface of each of the cylinder liners b located behind the fore cylinder liner b is elevated undesirably. For this reason, the conventional cooling system can not be employed especially for a large-sized engine adapted to generate a large output.

Additionally, where the water jacket c has a width W which is narrowed approaching the upper part thereof as shown in FIG. 5, and the cooling system is constructed such that a coolant flows from the fore side toward the rear side of an engine like the cooling system shown in FIG. 6, then the coolant flows at a lower speed in the region where the water jacket c has a narrower width, resulting in the cooling efficiency being degraded.

The present invention has been made with the foregoing background in mind and its object resides in providing a method of cooling a plurality of cylinder liners in an engine wherein the cooling efficiency of the cylinder liners is improved, the intake air charging efficiency is improved, properties in respect of the color of exhaust gas and the quality of particulates are improved and moreover the quantity of nitrogen oxides ($NO_x$) in the exhaust gas is reduced substantially.

DISCLOSURE OF THE INVENTION

To accomplish the above object, the present invention provides a method of cooling a plurality of cylinder liners in an engine including a step of forming a thermal insulating layer including an annular groove in the region in the vicinity of the upper part of each cylinder liner while surrounding the upper part of the cylinder liner in a spaced relationship relative to the cylinder liner in order to positively elevate the temperature on the wall surface of the cylinder liner at the upper part of the same and a step of forming a cylinder jacket in a cylinder block so as to allow the coolant to flow from the lower part toward the upper part of the cylinder liner, a cross-sectional area of the water jacket being gradually reduced from the lower part to the central part of the cylinder liner. With the method of the present invention, the cylinder liners are uniformly cooled by the coolant to maintain a low temperature thereof, whereby heat release for the initial period of combustion is reduced by shortening the period of delayed ignition, reduction of the combustion temperature and reduction of the quantity of nitrogen oxides are satisfactorily accomplished and moreover increase of the air excess rate and reduction of the temperature at the end of a compression stroke are satisfactorily accomplished.

DETAILED DESCRIPTION OF THE INVENTION

Now, the present invention will be described in detail hereinafter with reference to the accompanying drawings which illustrate a preferred embodiment of the present invention.

Figure 1:
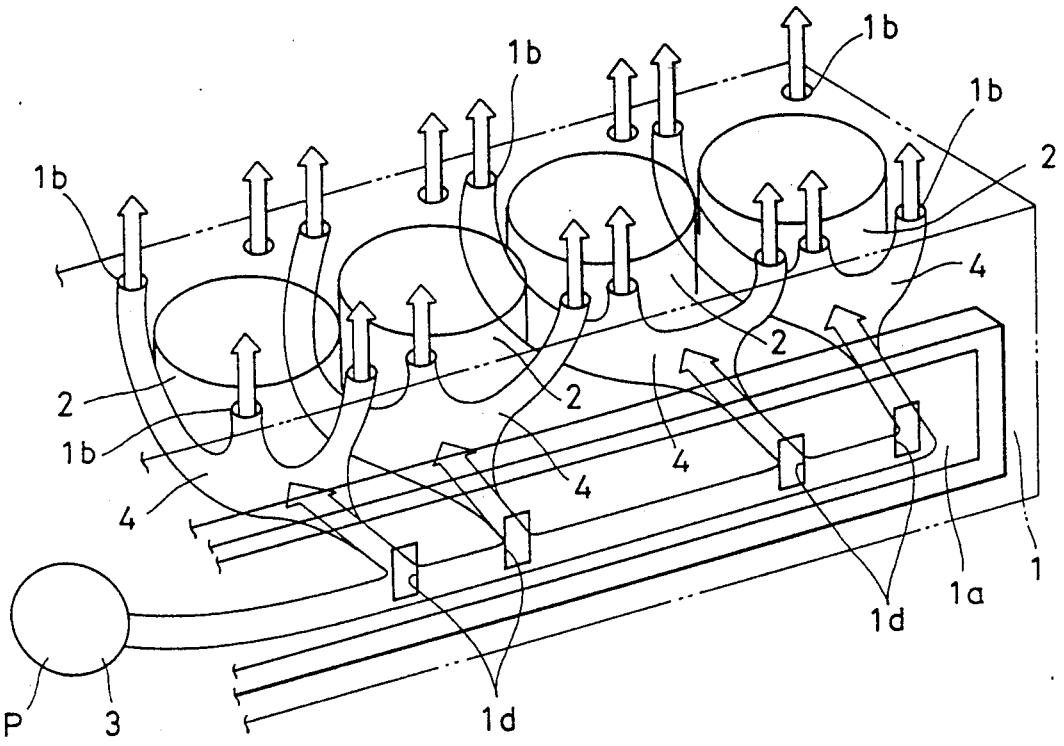
FIG. 1 is a perspective view which schematically illustrates arrangement of a number of coolant flow passages employable for practicing a method of cooling a plurality of cylinder liners in an engine in accordance with the present invention.

FIG. 1 is a perspective view which schematically illustrates arrangement of a number of flow passages for practicing a method of cooling a plurality of cylinder liners in an engine in accordance with the embodiment of the present invention. More particularly, the drawing illustrates a case where the method of the present invention is applied to a multicylinder engine having a plurality of cylinders arranged in parallel with each other.

As is apparent from the drawing, plural cylinder liners 2 (four cylinder liners) are arranged in a cylinder block 1 in accordance with the shown order as viewed from the front side to the rear side of the engine.

A coolant is discharged from a water pump 3. As the water pump 3 is driven, the coolant enters inlet ports 1*d* on a water manifold 1*a* which are formed at the positions located along the side wall of the cylinder block 1 in the longitudinal direction of the same. Flow passages for the coolant extending from the inlet ports 1*d* are divided into a plurality of branch passages of which number corresponds to the number of cylinder liners 2 so as to allow the coolant to flow in water jackets 4 which are formed around each cylinder liner 2.

Figure 2:
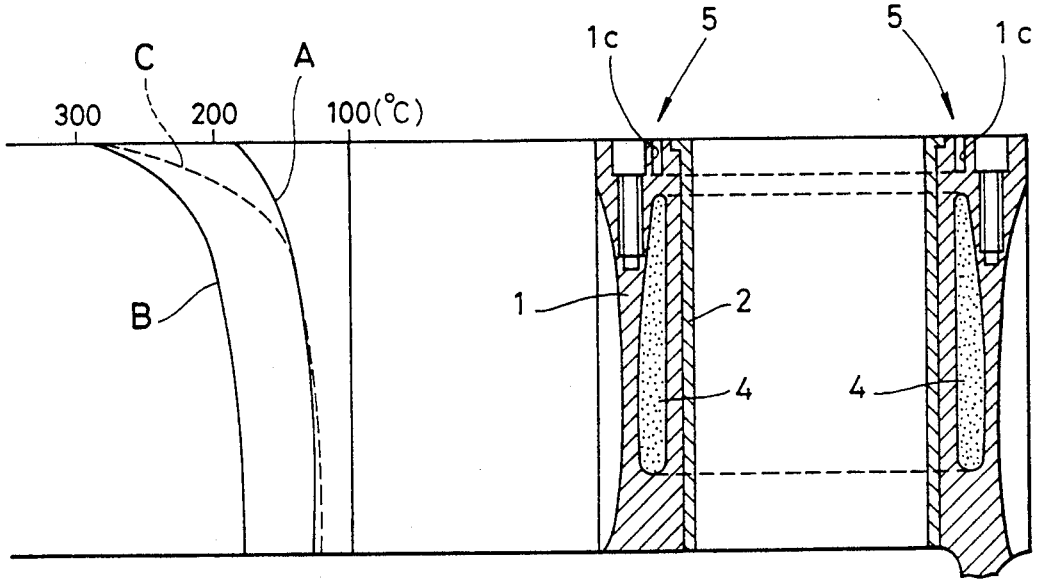
FIG. 2 is a fragmentary sectional view of the engine which shows essential components required for practicing the method in accordance with an embodiment of the present invention.

As shown in FIG. 2, each water jacket 4 is formed such that its sectional area is gradually reduced from the lower part to the upper part of the water jacket 4.

Figure 3A:
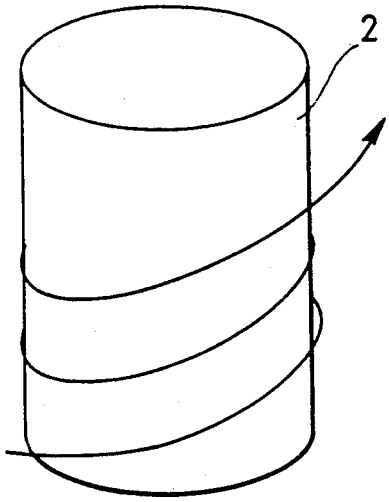
FIG. 3(*a*) and FIG. 3(*b*) are a perspective view of a cylinder liner which schematically illustrates a flow passage around the cylinder liner by way of which a coolant flows in the upward direction, respectively.
Figure 3B:
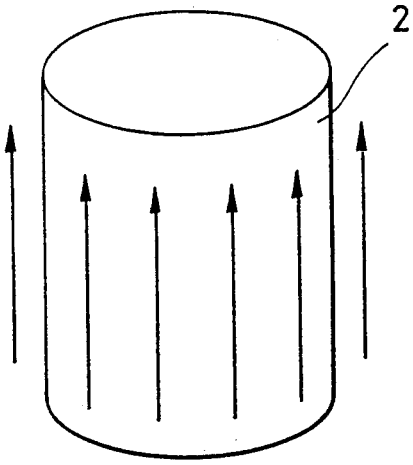
Figure 4:
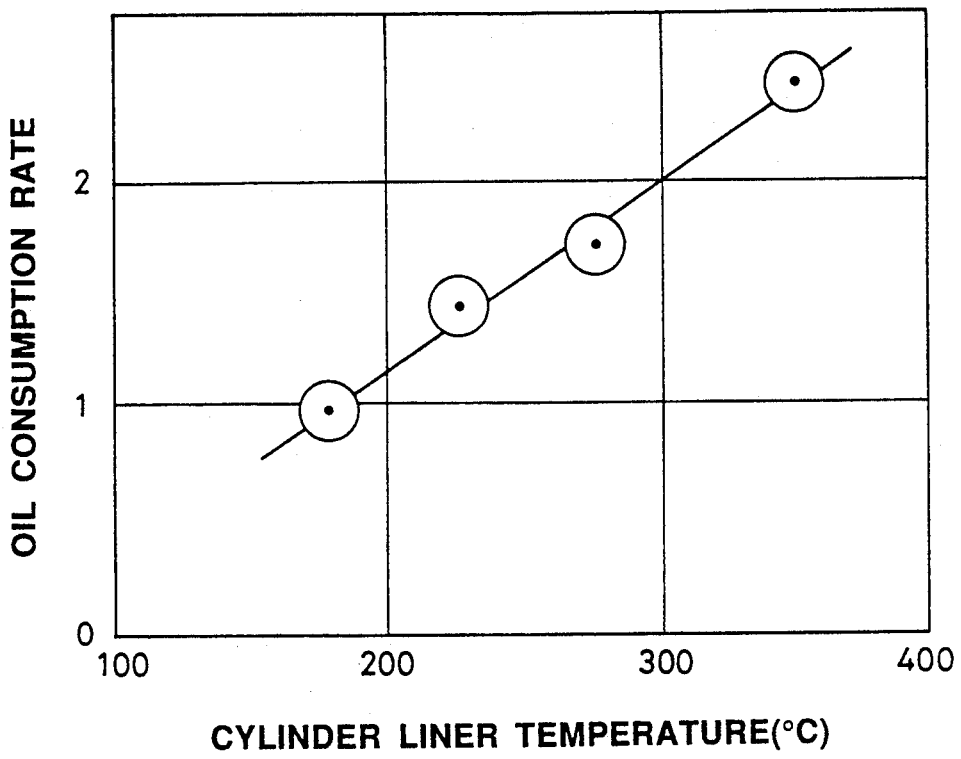
FIG. 4 is a graph which illustrates a relationship between the temperature on the wall surface of each cylinder liner and the quantity of consumption of a lubricant oil.
Figure 5:
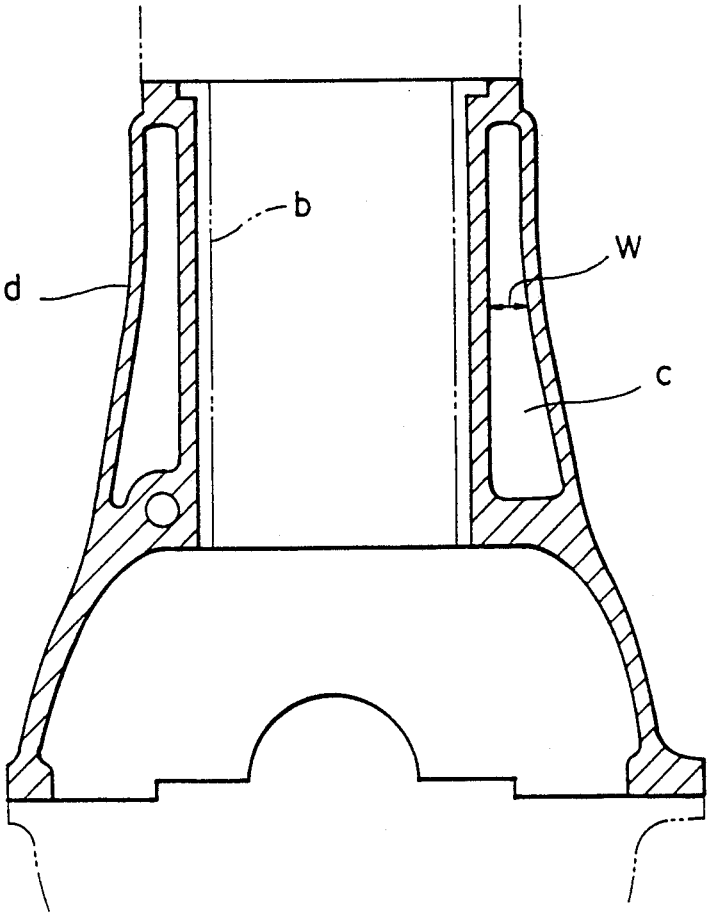
FIG. 5 is a fragmentary sectional view of an engine to which a conventional method of cooling a plurality of cylinder liners in the engine is applied.
Figure 6:
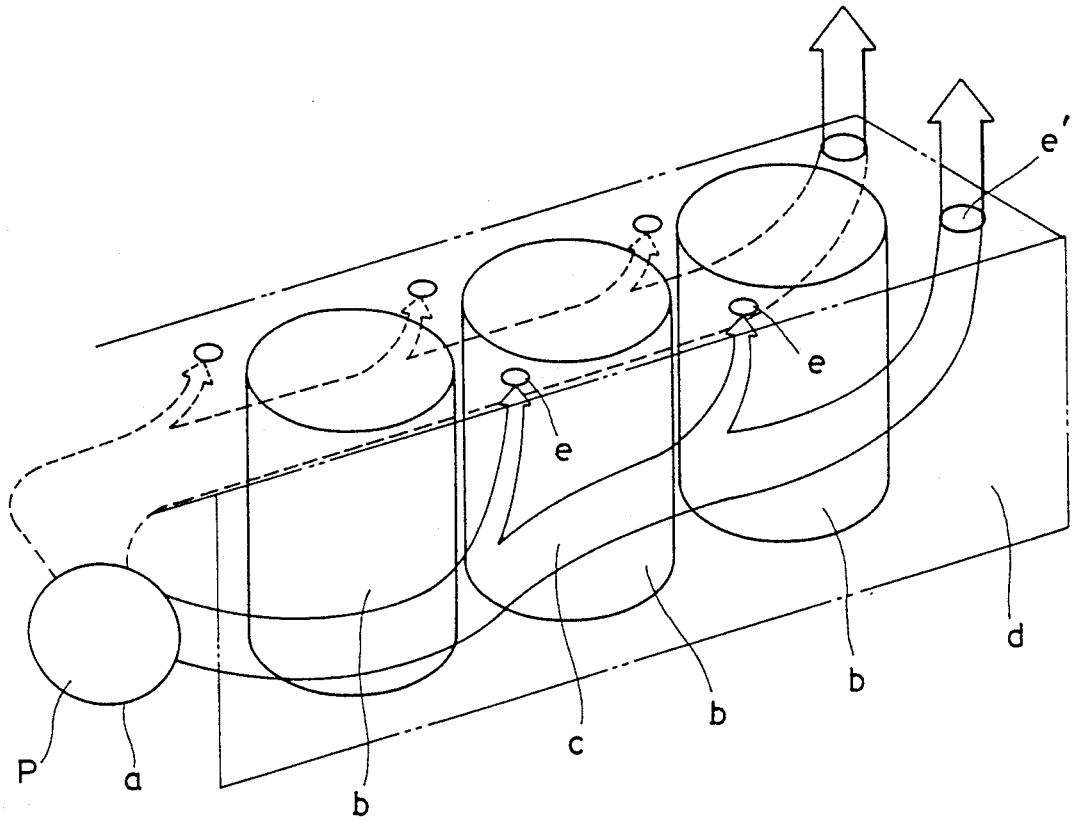
FIG. 6 is a perspective view which schematically illustrates arrangement of a plurality of coolant flow passages employable for practicing the conventional method.

The coolant which has flowed in the water jacket 4 from the lower side thereof rises in the longitudinal direction of the cylinder liner 2 while spirally turning around the wall surface of the cylinder liner 4, as schematically illustrated in FIG. 3(*a*). Alternatively, the coolant straightly rises along the wall surface of the cylinder liner in the upward direction, as illustrated in FIG. 3(*b*). As the coolant flows upwardly in that way, each cylinder liner 2 is cooled by the coolant which flows at the substantially same flow rate.

When the coolant reaches the upper part of the cylinder block 1, it is then delivered to a cylinder head (not shown) via a plurality of outlet ports 1*b* each having the substantially same sectional opening area, as shown in FIG. 1.

In addition, as shown in FIG. 2, a thermal insulating layer 5 in the shape of an annular groove is formed in the region about the periphery of and spaced from the cylinder liner 2.

The thermal insulating layer 5 thermally insulates the region in the vicinity of the upper dead point of the cylinder liner so as to positively elevate the temperature on the wall surface of the cylinder liner in the vicinity of the upper dead point. To this end, an annular groove 1*c* is formed in the cylinder block 1 in a concentric and spaced relationship relative to the cylinder liner 2 to accomplish thermal insulation at the upper part of the cylinder liner 2 in the presence of an air layer in the annular groove 1*c*.

Next, a method of cooling the cylinder liners 2 each constructed in the above-described manner will be described below. Additionally, the construction of each cylinder liner 2 will be described in more detail in the following manner.

As shown in FIG. 1, the coolant delivered from the water pump 3 flows in the water manifold 1*a*. Then, the coolant is divided into branch flows at the inlet ports 1*d* which communicate with the lower parts of the water jackets 4. Thus, each branch flow of the coolant is pumped to the lower part of each water jacket 4 at the substantially same flow rate.

As illustrated in FIG. 3(*a*) and FIG. 3(*b*), the coolant which has been pumped to the lower part of each water jacket 4 rises along the wall surface of the cylinder liner 2 while cooling the outer peripheral surface of the cylinder liner 2.

As shown in FIG. 2, the water jacket 4 is formed such that its sectional area is gradually reduced from the lower part toward the upper part of the water jacket 4. For this reason, the flow speed of the coolant which has been pumped in the water jacket 4 is accelerated as the coolant rises toward the upper part of the water jacket 4. As a result, as represented by a curve C in the graph in FIG. 2, the temperature on the wall surface of the cylinder liner 2 is lowered in the region ranging from the central part to the lower part of the cylinder liner 2. This means that the cylinder liner 2 is cooled by the coolant at an improved cooling efficiency and the wall temperature is maintained at a low level with uniform distribution thereof even when the engine generates a large heat output.

On the other hand, since the upper part of the cylinder liner 2 is thermally insulated by the thermal insulating layer 5 as shown in FIG. 2, the temperature in the region in the vicinity of the upper side of the cylinder liner 2 is largely elevated (as represented by the curve C in the graph in the drawing). Additionally, the coolant which has reached the upper part of the water jacket 4 as shown in FIG. 1 flows in the cylinder head (not shown) via a plurality of outlet ports 1*b* which are formed on the upper surface of the cylinder block 1, whereby the cylinder head is cooled by the coolant.

As described above, according to the present invention, the method of cooling a plurality of cylinder liners in an engine includes forming a thermal insulating layer in the region in the vicinity of the upper part of each cylinder liner while surrounding the cylinder liner in order to thermally insulate the upper part of the cylinder liner. Thus, the wall temperature at the upper part of the cylinder liner is substantially elevated, whereby the period of delayed ignition can be shortened and the combustion temperature can substantially be lowered by virtue of the reduction of heat release for an initial period of combustion. This leads to the result that the quantity of nitrogen oxides in an exhaust gas can be reduced.

Further, since the temperature on the wall surface of the cylinder liner is maintained at a possibly low level in the region ranging from the central part to the lower part of the cylinder liner, each cylinder is filled with intake air at a high charging efficiency, resulting in an air excess rate being improved. Consequently, an occurrence of malfunction such as deterioration of the color of the exhaust gas and deterioration of particulates in the exhaust gas can be prevented. Since a smaller quantity of lubricant oil is evaporated from the wall surface of each cylinder liner, the quantity of consumption of the lubricant oil can be reduced.

In addition, since cooling loss is reduced by suppressing escape of thermal energy to the cooling system, the cooling system can be constructed in smaller dimensions in contrast with the conventional cooling system. This leads to excellent advantageous effects that mechanical loss can be reduced and the engine can be operated with reduced fuel consumption cost.

While the present invention has been described above with respect to a single preferred embodiment thereof, it should of course be understood that the present invention should not be limited only to this embodiment but various changes or modifications may be made without departure from the scope of the invention as defined by the appended claim.

Industrial Applicability

The method of cooling a plurality of cylinder liners in an engine according to the present invention is preferably employable for an engine which requires the quantity of consumption of a lubricant oil to be reduced, the intake air charging efficiency to be improved, properties in respect of a color of exhaust gas and a quality of particulates to be improved and moreover generation of nitrogen oxides to be reduced substantially.

I claim:

1. An apparatus for cooling a cylinder liner in an engine, comprising:

a cylinder liner arranged in a cylinder block;

a thermal insulating channel formed in an upper portion of said block spaced from said cylinder liner for elevating the temperature on the wall surface of the cylinder liner at said upper portion; and a coolant jacket formed in the cylinder block so as to surround a portion of said cylinder liner, the coolant jacket having an inlet port for coolant formed at a lower side of the cylinder liner and an outlet port formed at an upper side of the cylinder liner.

2. An apparatus according to claim 1, wherein said channel comprises an annular groove formed in the cylinder block so as to surround the cylinder liner.

3. An apparatus for cooling cylinder liner in an engine, comprising:

a plurality of cylinder liners juxtaposed in a cylinder block;

a plurality of thermal insulating areas formed in the cylinder block, each of said areas being located near and spaced from an upper portion of a cylinder liner, for elevating the temperature on the wall surface of each cylinder liner at said upper portion;

a plurality of water jackets formed in the cylinder block, a water jacket surrounding each of said cylinder liners, each water jacket having an inlet port for water formed at a lower side of each cylinder liner and an outlet port formed at the upper side of each cylinder liner; and a water manifold formed on a side wall of said cylinder block, for introducing the water into each inlet port of each water jacket.

4. An apparatus according to claim 3, wherein each of the thermal insulating areas comprises an annular groove formed in the cylinder block so as to surround each cylinder liner.

* * * * *